US009397397B2

(12) United States Patent
Beeker et al.

(10) Patent No.: US 9,397,397 B2
(45) Date of Patent: Jul. 19, 2016

(54) ELECTRONICALLY-STEERED KU-BAND PHASED ARRAY ANTENNA COMPRISING AN INTEGRATED PHOTONIC BEAMFORMER

(71) Applicant: Universiteit Twente, Enschede (NL)

(72) Inventors: Willem Paul Beeker, Cambridge (GB); Chris Gerardus Hermanus Roeloffzen, Weerselo (NL); Leimeng Zhuang, Zwolle (NL); Johannes Wilhelmus Eikenbroek, Emmen (NL); Paul Klatser, Markelo (NL); Paulus Wilhelmus Leonardus van Dijk, Tilburg (NL)

(73) Assignee: Universiteit Twente (NL)

( * ) Notice: Subject to any disclaimer, the term of this patent is extended or adjusted under 35 U.S.C. 154(b) by 761 days.

(21) Appl. No.: 13/644,227

(22) Filed: Oct. 3, 2012

(65) Prior Publication Data

US 2013/0194134 A1 Aug. 1, 2013

Related U.S. Application Data

(60) Provisional application No. 61/542,385, filed on Oct. 3, 2011.

(51) Int. Cl.
*H01Q 3/00* (2006.01)
*H01Q 3/26* (2006.01)
*H01Q 21/00* (2006.01)

(52) U.S. Cl.
CPC ..... *H01Q 3/2682* (2013.01); *H01Q 3/2676* (2013.01); *H01Q 21/0087* (2013.01)

(58) Field of Classification Search
CPC H01Q 3/2682; H01Q 3/2676; H01Q 21/0087
USPC ..... 342/368
See application file for complete search history.

(56) References Cited

U.S. PATENT DOCUMENTS

| | | | | |
|---|---|---|---|---|
| 5,245,628 | A * | 9/1993 | LaPadula et al. | 375/148 |
| 6,452,546 | B1 * | 9/2002 | Stephens | 342/368 |
| RE38,809 | E * | 10/2005 | Yao | 359/256 |
| 7,535,409 | B1 * | 5/2009 | Choe et al. | 342/159 |
| 2003/0052819 | A1 * | 3/2003 | Jacomb-Hood et al. | 342/379 |
| 2012/0319885 | A1 * | 12/2012 | Chang | 341/155 |

* cited by examiner

*Primary Examiner* — Frank J McGue
(74) *Attorney, Agent, or Firm* — Kaplan Breyer Schwarz & Ottesen, LLP

(57) ABSTRACT

A phased-array antenna that includes a photonic beamformer is disclosed. In some embodiments, a front stage of electrical-domain processing applies a 16-to-1 signal-combination ratio, a single stage of photonic beamforming applies a 4-to-1 signal-combination ratio, and a passive, electrical-domain, signal combiner applies a 32-to-1 signal-combination ratio.

21 Claims, 13 Drawing Sheets

ELECTRONICALLY-STEERED KU-BAND PHASED ARRAY ANTENNA COMPRISING AN INTEGRATED PHOTONIC BEAMFORMER

CROSS REFERENCE TO RELATED APPLICATIONS

This case claims the benefit of U.S. Patent Application 61/542,385, filed Oct. 3, 2011 and is incorporated herein by reference.

FIELD OF THE INVENTION

The present invention relates to phased-array antennas.

BACKGROUND OF THE INVENTION

Mobile satellite communications, such as aeronautic/avionic satellite communications, require low-profile and lightweight antenna systems. The antenna systems used for such applications are usually electronically-steered phased arrays. Such systems desirably provide instantaneous reception of the full $K_u$-band (10.7-12.75 GHz), squint-free, and seamless beam steering, as well as polarization agility.

It is quite challenging to produce an antenna system having multi-gigahertz instantaneous bandwidth, compact form factor, light weight, and large beam-scanning range via beam formers that use only electronics-based technologies. As a consequence, phased-array antenna systems using photonic beamformers have been proposed. Compared to all-electrical-domain antenna systems, systems that incorporate photonic circuits can be more compact size and have lighter weight, among other benefits.

SUMMARY OF THE INVENTION

The present invention provides an electronically-steered phased-array antenna that avoids some of the costs and drawbacks of currently proposed phased-array antennas that incorporate photonic beamformers.

The illustrative embodiment of the present invention is a phased-array receive antenna that includes, as its salient elements: (i) an antenna, (ii) front-end, electrical-domain processing elements, (iii) photonic beamformers, and (iv) two passive, electrical-domain, signal combiners.

The antenna consists of a plurality of antenna elements. In the illustrative embodiment, the antenna elements are patch antennas. Each patch antenna is sensitive to two orthogonal polarizations and generates two signals consistent therewith in response to receiving a transmission, such as a $K_u$-band satellite transmission.

System performance dictates the number of antenna elements that are required. The illustrative embodiment incorporates 2048 antenna elements which are organized into a plurality of "tiles," each of which comprises an 8×8 array of antenna elements. The antenna elements are quite small; each tile, which consists of 64 antenna elements, is about 10 centimeters square. The tiles are arranged in a somewhat circular pattern within a frame that is about 60 to 80 centimeters in diameter.

The 2048 antenna elements of the illustrative embodiment each generate two signals with orthogonal, linear polarizations (one "X"-polarized and the other "Y"-polarized) for a total of 4096 signals when they receive a $K_u$-band transmission. The phased-array antenna system must combine these signals so that ultimately two signals—one of each polarity—remain. These two signals are then processed by a satellite receiver.

Combining these multiple thousands of signals requires various processing elements and operations, such as, for example, signal amplification, frequency down conversion, delay, polarization conversion, and, of course, signal combination.

Although these operations are not unique in terms of existing proposals for phased-array antenna systems incorporating photonic circuits, it will be appreciated that there are a large number of potential approaches for processing the signals. For example, there are a variety of ways in which the processing can be distributed between the electrical and optical domains. Furthermore, there are many options in terms of what particular signal-combination ratio is adopted at any given stage of the processing. Also, there are a variety of ways to group the various antenna elements for signal processing.

All approaches to this problem are not equal. The challenge facing the inventors was to develop an architecture and processing methodology that, in addition to achieving certain system performance goals, would reduce the cost of the system and improved antenna flexibility with respect to existing proposals.

An earlier architecture (authored by some of the present inventors) for a phased-array antenna that incorporates photonic beamformers was organized as follows. The antenna comprised 2048 antenna elements arranged into thirty-two 8×8 arrays, each array defining a tile. The same number of antenna elements (2048) and the same arrangement (thirty-two 8×8 arrays) has been adopted by the present inventors for use in the illustrative embodiment.

The earlier architecture processed the signals in sixteen groups of four antenna elements. Each 8×8 array was thus logically divided into sixteen groups of four antenna elements each. Signal processing, including a 4-to-1 signal-combination ratio, was applied to the signals generated by the four antenna elements. Focusing on only one of the signal polarities for simplicity, this reduced the sixty-four signals generated by the antenna elements in a given tile to sixteen signals. In other words, the original 2048 signals (focusing on only one polarity) were reduced to 512 signals. That completed the front-end, electrical-domain signal processing.

The sixteen signals (from a given tile) were then processed in a 16×1 photonic beamformer. The beamformer applied delays to the sixteen signals being processed, thereby accounting for the spatial separation between the sixteen groups of four antenna elements that generated those signals. The beamformer provided a 16-to-1 signal-combination ratio, thereby reducing the sixteen signals to a single output signal. Thirty-two of such 16×1 photonic beamformers were required to process the sixteen signals from each of the thirty-two tiles. Thus the number of signals (of one particular polarity) was reduced from 512 to 32; that is, one signal per tile.

Following this first stage of photonic beamforming, the signals were subjected to a second stage of photonic beamforming in a single 32×1 beamformer. Before entering the second stage, the signals were converted back to the electrical domain and then sent to the modulators of the second stage beamformer to "re-generate" the optical signals. This was required because laser light generated by each of the 32 separate lasers (for the 32 separate first stage 16×1 beamformers) is not be coherent. In the second stage, delays were applied to each of the thirty-two signals to account for the spatial separation between the tiles and the signals were combined to a single optical signal. That signal was then converted back to the electrical domain to complete the processing.

This earlier approach therefore adopted 4-to-1 signal-combination ratio in the electrical domain, a first stage of 16-to-1 signal combination in the optical domain, and a second stage of 32-to-1 signal combination in the optical domain.

Although the previous architecture presented a functional design that was expected to meet performance goals, the present inventors sought ways to improve the design. Among any number of other approaches considered, the inventors serendipitously explored the effect that redistributing the functionality of the second stage beamformer might have on the system. In particular, the inventors examined the effect of handling, in the electrical domain, at least some of the signal combination that had previously been done in the optical domain.

A design was developed, somewhat surprisingly, that reduced the number of optical beamforming stages to one. This reduced the number of electrical-photonic domain interfaces. Since a loss in signal strength occurs at each electrical/photonic interface, this reduction in the number of electrical-to-photonic interfaces preserves signal strength, thereby enhancing system performance. Furthermore, using a single photonic stage rather than two such stages should increase production yield, decrease production costs, decrease system integration cost, reduce laser-power requirements, and increases antenna design flexibility.

In the illustrative embodiment, the architecture is structured to provide:

(1) an antenna arranged in discrete tiles comprising 8×8 arrays of antenna elements;

(2) electrical-domain processing elements arranged to provide a 16-to-1 signal-combination ratio in front-end processing, wherein the processing is based on groupings containing (i) sixteen antenna elements (called "sub-tiles") and (ii) four antenna elements (called "blocks");

(3) a single stage of photonic beamforming, wherein the beamformers are arranged to provide a 4-to-1 signal-combination ratio and handle all inter-tile delay, as well as some intra-tile delays; and (4) a passive, electrical-domain, signal combiner that receives the output from photonic beamforming (32 signals, considering only one of the two polarities; that is, one signal per tile), and combines them into 1 signal, thereby providing a 32-to-1 signal-combination ratio.

The illustrative embodiment of invention uses many of the same elements and processing operations as past proposals for a phased-array antenna with photonic beamforming (e.g., amplification, frequency down conversion, delay, polarization conversion, and signal combination). Whatever the similarities, the changes in the approach to processing that are incorporated in the illustrative embodiment surprisingly result in a significantly improved phased-array antenna design in terms of both cost and system flexibility.

DETAILED DESCRIPTION

The illustrative embodiment of the present invention is a phased-array receive antenna for $K_u$-band satellite transmission. It will be appreciated that substantially the same antenna architecture can be used to receive both higher and lower frequency-band transmissions. As will be appreciated by those skilled in the art, when used to receive transmissions of such other frequency bands, the size of the antenna elements will necessarily be different. Furthermore, the number of antenna elements required for the antenna is likely to be different than the illustrative embodiment. Additionally, the design of many of the electrical-domain processing elements may require alteration. After reading this specification, those skilled in the art will be able to make and use a phased-array antenna according to the present teachings as suitably modified for processing other frequency bands of signal transmissions.

Overview.

Figure 1:
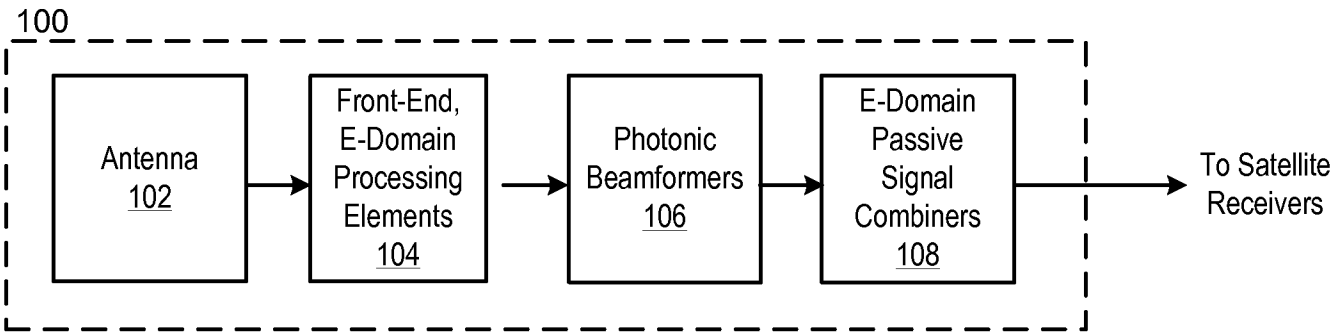
FIG. 1 depicts a block diagram of the system architecture for a phased-array antenna in accordance with the illustrative embodiment of the present invention.

FIG. 1 depicts a high-level block diagram of a system architecture for phased-array antenna 100 in accordance with the illustrative embodiment of the present invention. Phased-array antenna 100 comprises antenna 102, front-end electrical-domain processing elements 104, photonic beamformers 106, and electrical-domain, passive signal combiners 108, interrelated as shown. The output from each signal combiner 108 is transmitted to one or more satellite receivers.

Antenna 102 comprises a plurality of individual "antenna elements," each of generates two signals in response to receiving an electromagnetic ("EM") signal, such as a $K_u$-band satellite transmission. Antenna 102 is discussed in more detail in conjunction with FIGS. 2 and 3.

Front-end processing elements 104 receive the signals generated by the antenna elements. The front-end processing elements perform electrical-domain processing of these signals, performing such tasks as signal amplification, frequency down-conversion, signal delay, signal combination, and polarity conversion, among any other tasks. Front-end processing elements 104 are discussed in more detail later in this disclosure in conjunction with FIGS. 4 and 5A-5B.

Photonic beamformers 106 receive the electrical signals from front-end electrical-domain processing and convert them to the optical domain. The optical signals are launched into a network of waveguides that impart signal delays and accomplish some signal combination. Photonic beamformers 106 are discussed in further detail later in conjunction with FIGS. 6, 7A, 7B, and 8.

Electrical-domain, passive signal combiners 108 receive, after conversion back to the electrical domain, the signals from photonic beamformers 106. The signal combiners, of which there are two in the illustrative embodiment, each output a single signal. The two output signals, which have orthogonal polarities, are then transmitted to a receiver, such as a satellite receiver.

Detailed Architecture.

Figure 2:
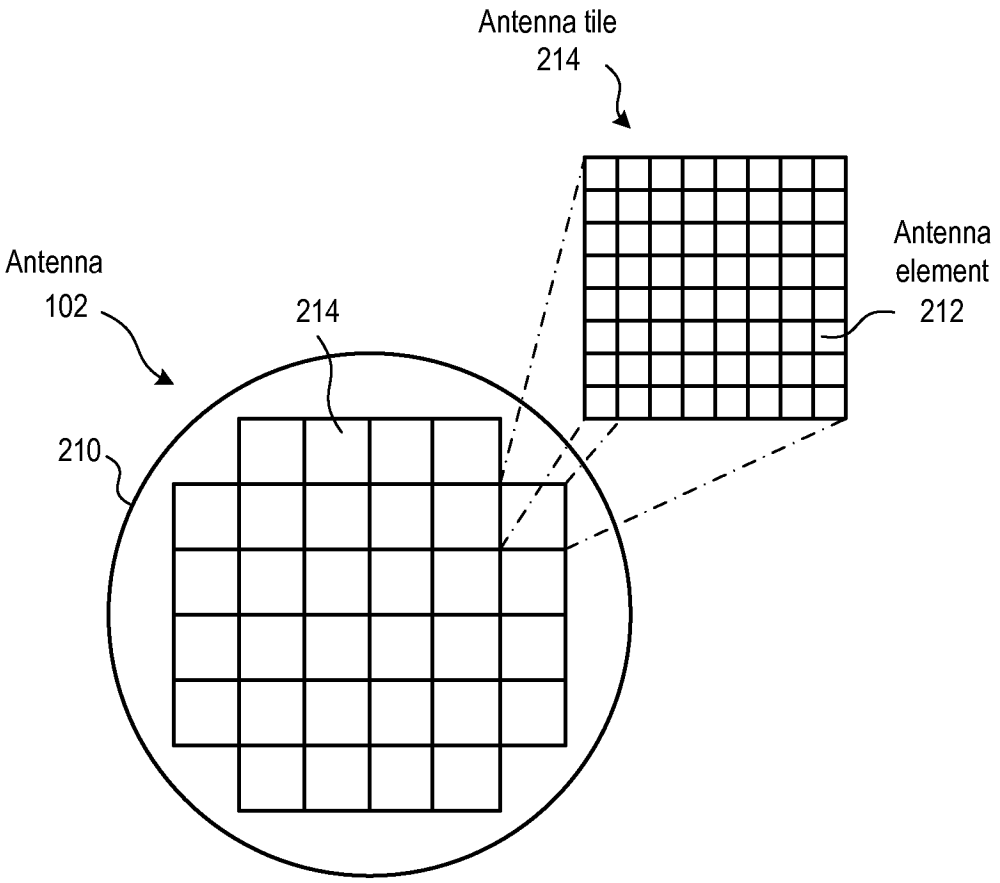
FIG. 2 depicts an embodiment of an antenna for use with the phased-array antenna of FIG. 1.

Referring now to FIG. 2, antenna 102 comprises a plurality of individual "antenna elements" 212. An antenna element (hereinafter "AE") is the basic functional unit of antenna 102. In the illustrative embodiment, each AE is a conventional patch antenna. The patch antenna is sensitive to two orthogonal polarities of the received signal and provides two output voltage signals, "X" and "Y," corresponding thereto. Antenna 102 is discussed in more detail in conjunction with FIGS. 2 and 3.

The number of AEs 212 included in an antenna, such as antenna 102, is a function of system requirements/target specifications, which can be determined by one skilled in the art. In the illustrative embodiment, antenna 102 includes 2048 AEs. AEs 212 are arranged in a somewhat circular pattern. The circular pattern is desirable because it tends to minimize the distance between (the most remote) antenna elements, thereby minimizing signal time delays across the antenna, which must be addressed in the electrical and/or optical domains.

AEs 212 are organized into a plurality of "tiles" 214. In the illustrative embodiment, each tile 214 comprises sixty-four AEs 212 configured as an 8×8 array. This arrangement results in thirty-two tiles (for 2048 AEs). The tiles are discrete elements in the sense that the front-end processing elements and the photonics for all of the AEs associated with a particular tile are located beneath the tile and form an integrated structure therewith. The integration of the electronic and photonic domain circuits are discussed later in this disclosure in conjunction with FIG. 9.

Tiles 214 (and underlying electronic and photonic circuits) are supported on frame 210, which can be, without limitation, aluminum.

Figure 3:
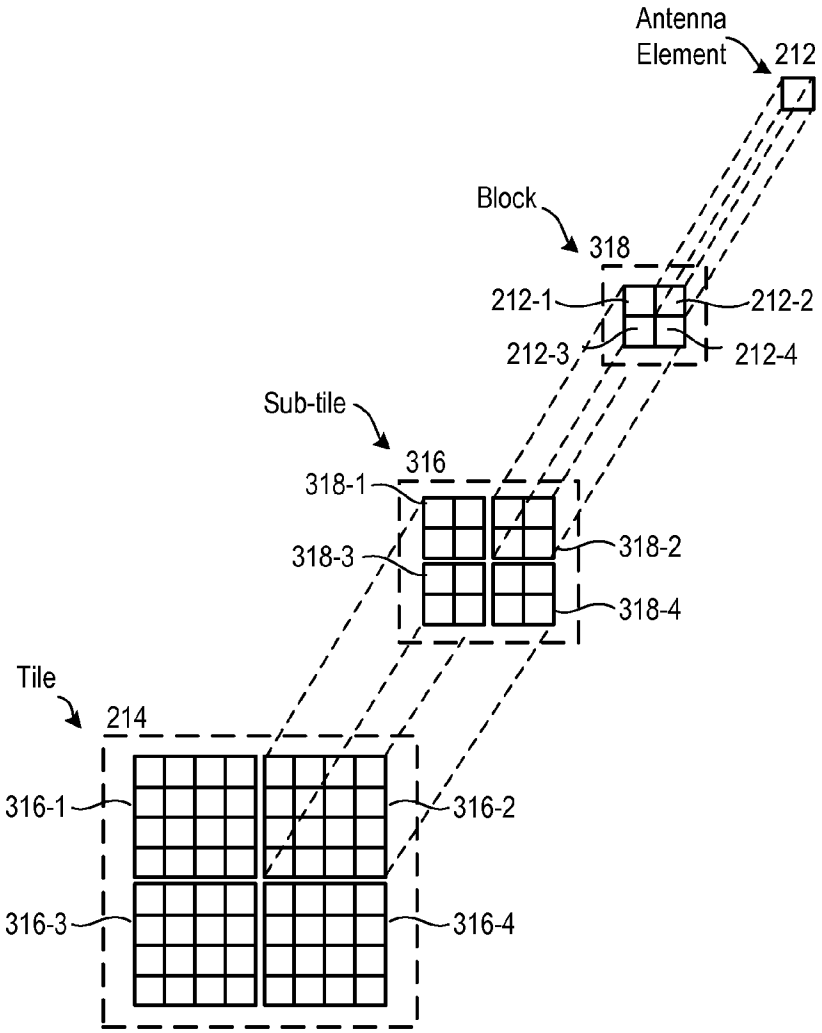
FIG. 3 depicts various logical groupings of antenna elements of the antenna of FIG. 2.

FIG. 3 depicts certain additional groupings of AEs 212. The groupings are relevant to an understanding of the present invention because electrical interconnections from antenna elements 212 to front-end electrical-domain processing elements 104, and from the processing elements to photonic beamformers 106 will reflect such groupings.

As depicted in FIG. 3, the 64 AEs of tile 214 are logically segregated into four "sub-tiles" 316-1, 316-2, 316-3, and 316-4, arranged in a 2×2 array. Each sub-tile 316 includes sixteen AEs 212. Each sub-tile 316 is, in turn, logically segregated into four "blocks" 318-1, 318-2, 318-3, and 318-4, arranged in a 2×2 array. Each block 318 comprises four antenna elements 212-1, 212-2, 212-3, and 212-4, arranged in a 2×2 array.

Front-End, Electrical-Domain Processing.

Figure 4:
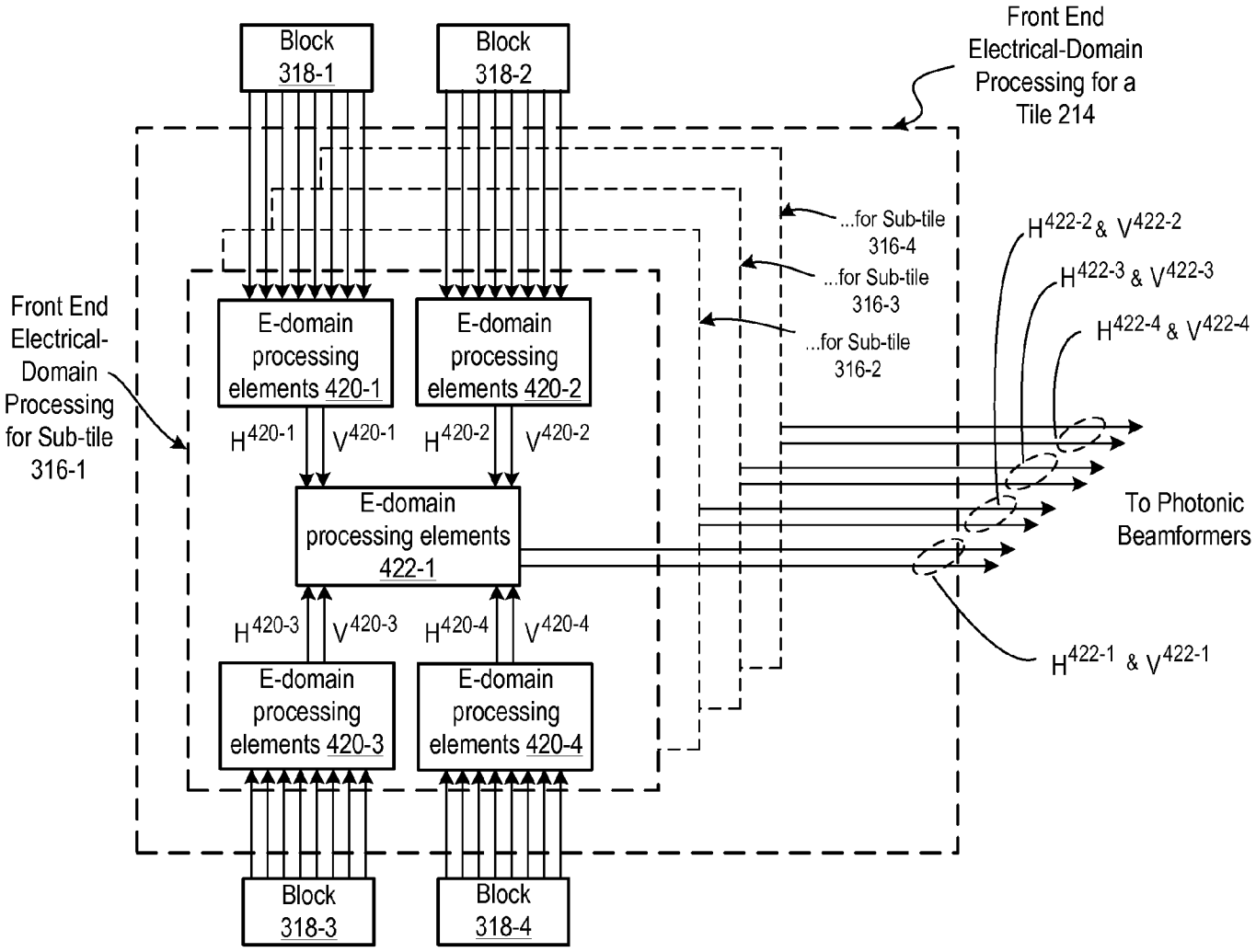
FIG. 4 depicts a high-level block diagram of the front end, electrical-domain processing of signals generated by the antenna elements of the antenna of FIG. 2.

FIG. 4 depicts a high-level diagram of front-end processing elements 104 and processing accomplished thereby for a single tile 214. In the illustrative embodiment, front-end processing elements 104 are configured to provide a signal-combination ratio of 16-to-1. As depicted, the signals from each of the four sub-tiles 316-1, 316-2, 316-3, 316-4 are separately processed, wherein the processing generates two signals for each sub-tile (e.g., $H^{422-1}$ and $V^{422-1}$, etc.). The signal processing for each sub-tile 316 is identical to that of other sub-tiles and is shown for sub-tile 316-1 in FIG. 4.

As previously discussed, each sub-tile 316 comprises four blocks 318. Thus, sub-tile 316-1 comprises blocks 318-1, 318-2, 318-3, and 318-4. Each block of AEs generates eight signals (i.e., two signals for each of the four AEs in a block). The signals from each block 318 are processed by substantially identical sets of electronic-domain processing elements 420-1, 420-2, 420-3, and 420-4. Processing elements 420 represent a first portion of front-end processing elements 104 for processing the signals generated by the AEs of a tile 214. Processing elements 420 are discussed in further detail in conjunction with FIG. 5A.

With continuing reference to FIG. 4, each of the four sets of processing elements 420 generates two output signals from the eight signals received thereby. As discussed in more detail in conjunction with FIG. 5A, one of the output signals is "H-" polarized and the other of the two output signals is "V-" polarized. Thus, the four sets of processing elements 420-1, 420-2, 420-3, and 420-4 collectively output eight signals, which are respective signals $H^{420-1}$ and $V^{420-1}$, $H^{420-2}$ and $V^{420-2}$, $H^{420-3}$ and $V^{420-3}$, and $H^{420-4}$ and $V^{420-4}$. These eight signals are received by electrical-domain processing elements 422-1, which represent the second portion of front-end processing elements 104 required for processing the signals generated by the AEs to achieve a 16-to-1 signal-combination ratio. Processing elements 422, which output two signals, are discussed in further detail in conjunction with FIG. 5B.

Front end electronics 104 for handling the processing for a single sub-tile 316 (such as sub-tile 316-1) thus receives thirty-two signals from 16 AEs 212 (four AEs in each of the four blocks 318) and outputs two signals: one H-polarized signal $H^{422-1}$ and one V-polarized signal $V^{422-1}$.

Recalling that in the illustrative embodiment, each tile 214 comprises four sub-tiles 316, processing identical to that described above for sub-tile 316-1 is performed for each of the three other sub-tiles 316-2, 316-3, and 316-4. The thirty-two signals from each of those additional sub-tile groupings are processed by identical instances of front end electronics 104 to yield two signals. As such, the processing of signals from sub-tile 316-2 generates signals $H^{422-2}$ and $V^{422-2}$, the processing of signals from sub-tile 316-3 generates signals $H^{422-3}$ and $V^{422-3}$, and the processing of signals from sub-tile 316-4 generates signals $H^{420-4}$ and $V^{420-4}$.

In this fashion, front end processing elements 104 processes the one hundred twenty-eight signals generated by sixty-four AEs of a single tile and outputs eight signals. This equates to a signal-combination ratio of 16-to-1. The eight signals generated by front-end electronics 104 for one tile 214 are then converted to the optical domain and processed by photonic beamformers 106. This same processing occurs for each tile 214 of antenna 102.

In some embodiments, electrical-domain processing elements 420 for a given block 318 of AEs are disposed on a single integrated circuit; preferably an application specific integrated circuit ("ASIC"). In such embodiments, four identical chips provide the first portion of the processing required for each sub-tile 316. Electrical-domain processing elements 422 for a given sub-tile (i.e., four blocks) are disposed on an additional chip. Thus, for each sub-tile 316, front end processing elements 104 are disposed on five chips: four of a first type ("ASIC-1") and one of a second type ("ASIC-2"). Since each tile 214 comprises four sub-tiles 316, the chip set for a single tile requires sixteen ASIC-1 chips and four ASIC-2 chips.

Figure 5A:
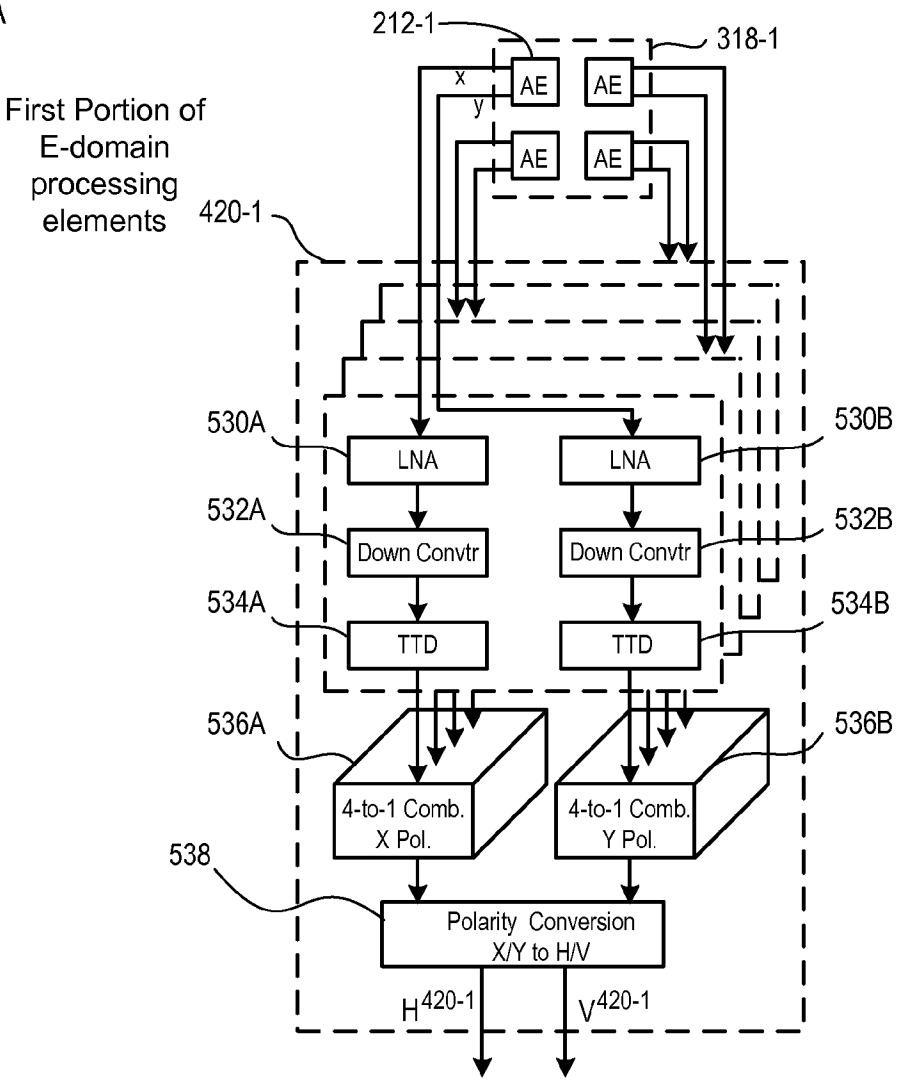
FIG. 5A depicts an embodiment of a first portion of the front end, electrical-domain processing elements required for the electrical-domain processing of signals from the antenna elements.

FIG. 5A depicts further details of an embodiment of electrical-domain processing elements 420. In particular, this Figure depicts a portion of the front-end processing elements and the process flow for the four "X"-polarized and four "Y"-polarized signals generated by the four AEs 212 of block 318-1. As is clear from FIG. 4, there are three further instances of the same process elements to process the signals generated from the other three blocks (318-2, 318-3, and 318-4) of sub-tile 316-1.

As depicted in FIG. 5A, the X-polarized signals and the Y-polarized signals are handled separately. FIG. 5A depicts the processing of the two signals from a single AE; namely AE 212-1. This processing is repeated for the other three AEs of block 318-1.

The X-polarized signal is processed, in turn, by low noise amplifier 530A, down converter 532A, and true time delay 534A. Similarly, the Y-polarized signal is processed by low noise amplifier 530B, down converter 532B, and true time delay 534B.

In some embodiments, such as when addressing heavy noise and gain specifications, low noise amplifiers 530A and 530B each include two cascaded amplifiers, wherein matching and load networks are implemented via inductors. Center frequency is advantageously tunable, such as via the use of a DAC and a varactor, since it is difficult to achieve a desired resonance frequency due to uncertainty in inductor values. Those skilled in the art will be able to design and use low noise amplifiers for use in conjunction with phased-array antenna 100.

Down converters 532A and 532B reduce the frequency of the signal from Ku band (10.7 GHz to 12.75 GHz) to intermediate frequency ("IF") in the range of about 0.95 GHz to about 3 GHz, such as via the use of local oscillators, in known fashion. Operating at IF, as opposed to higher frequency operation, results in less power consumption, a reduced chance of oscillations, more accurate signal processing, and simplified design, among other benefits. Those skilled in the art will be able to design and use a down converter for use in conjunction with phased-array antenna 100.

True time delays 534A and 534B are used to account for delays between signals from the four AEs in block 318-1. These delays occur because the AEs are spatially displaced from one another and receive incoming EM transmissions at slightly different times. It is notable that a pure phase shifter is not preferred for this application because its use would result in a non-constant group delay over the frequency band.

The delay required at this point in the processing is quite small, since, in accordance with the illustrative embodiment, the signals being processed are from four adjacent AEs, each of which is physically quite small. To minimize any such delay, the signals are from four AEs that are spatially positioned in a 2×2 array, as opposed to four AEs that are positioned linearly with respect to one another. In some embodiments, the electrical domain true time delay is implemented as a second order Bessel LP-filter. Those skilled in the art will be able to design and use a true time delay for use in conjunction with phased-array antenna 100.

After processing by true time delay 534A, the X-polarized signal is received by 4-to-1 combiner 536A and the Y-polarized signal is received by 4-to-1 combiner 536B. Combiner 536A receives, after time-delay processing, the X-polarized signal from each of the four AEs of block 318-1. Similarly, combiner 536B receives a time-delayed Y-polarized signal from each of the four AEs of block 318-1. Combiner 536A generates a single X-polarized signal and combiner 536B generates a single Y-polarized signal.

In some embodiments, each of the combiners 536A and 536B is implemented via four transconductance amplifiers. These amplifiers convert voltage to current; each combiner receives four voltage signals and generates four current signals. The four current signals are summed and fed to a resistor to convert the current-domain signal back to the voltage domain, thereby generating a single voltage-domain output signal from each combiner.

The X-polarized signal from combiner 536A is converted to an H-polarized signal and the Y-polarized signal from combiner 536B is converted to a V-polarized signal via polarity converter 538 in conventional fashion. The output from polarity converter 538 is thus two signals: H-polarized signal $H^{420-1}$ and V-polarized signal $V^{420-1}$.

Recall from FIG. 4 that the processing identical to that performed by processing elements 420-1 for the four signals from block 318-1 is also performed by processing elements 420-2, 420-3, and 420-4 for signals from respective blocks 318-2, 318-3, and 318-4.

Figure 5B:
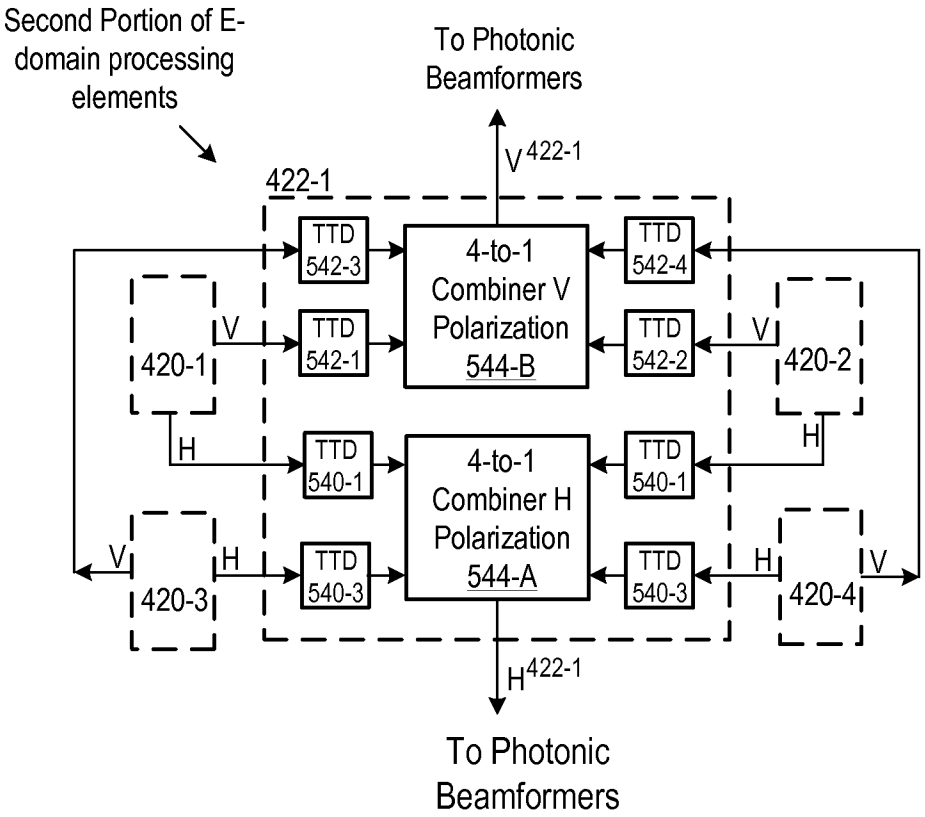
FIG. 5B depicts an embodiment of a second portion of the front-end, electrical domain processing elements required for the electrical-domain processing of signals from the antenna elements.

Referring now to FIGS. 5B and 4, the eight signals ($H^{420-1}$ and $V^{420-1}$, $H^{420-2}$ and $V^{420-2}$, $H^{420-3}$ and $V^{420-3}$, and $H^{420-4}$ and $V^{420-4}$) generated by processing elements 420-1, 420-2, 420-3, and 420-4 are processed by electrical-domain processing elements 422-1. As depicted in FIG. 5B, processing elements 422-1 comprise two 4-to-1 combiners: combiner 544A for combining four H-polarized signals and combiner 544B for combining four V-polarized signals. Before being combined in the combiners, each signal is processed by a true time delay. Delays 540-1, 540-2, 540-3, and 540-4 receive respective H-polarized signals $H^{420-1}$, $H^{420-2}$, $H^{420-3}$, and $H^{420-4}$. Time delays 542-1, 542-2, 542-3, and 542-4 receive respective V-polarized signals $V^{420-1}$, $V^{420-2}$, $V^{420-3}$, and $V^{420-4}$. The delays provided by these elements are required to account for the spatial displacement between the various blocks 318-1, 318-2, 318-3, and 318-4 of AEs. Recall that true time delays 534A and 534B of processing elements 420-1, etc., only account for delays between the AEs within a given block.

As previously disclosed in conjunction with FIG. 4, each combiner 544 outputs one signal: H-polarized signal $H^{422-1}$ from combiner 544A and V-polarized signal $V^{422-1}$ from combiner 544B.

As previously explained in conjunction with the discussion of FIG. 4, four instances of processing elements 422-1 depicted in FIG. 5B are required to process all one hundred twenty-eight signals from the AEs of a single tile.

The processing discussed above in conjunction with FIGS. 4, 5A, and 5B, which is the electrical-domain processing performed by front-end processing elements 104, is performed for each tile 214 of antenna 102. Since the illustrative embodiment of antenna 102 has 32 tiles 214, there are thirty-two identical instances of front end processing elements 104. The integration of an individual tile 214 and front end processing elements 104 associated therewith is discussed later in this disclosure in conjunction with FIG. 8.

Having completed the front-end electrical domain processing of the signals from the AEs whereby a 16-to-1 reduction in the number of signals occurs, the signals are ready to be processed by photonic beamformer 106 (see FIG. 1).

The Single Stage of Photonic Beamforming.

Figure 6:
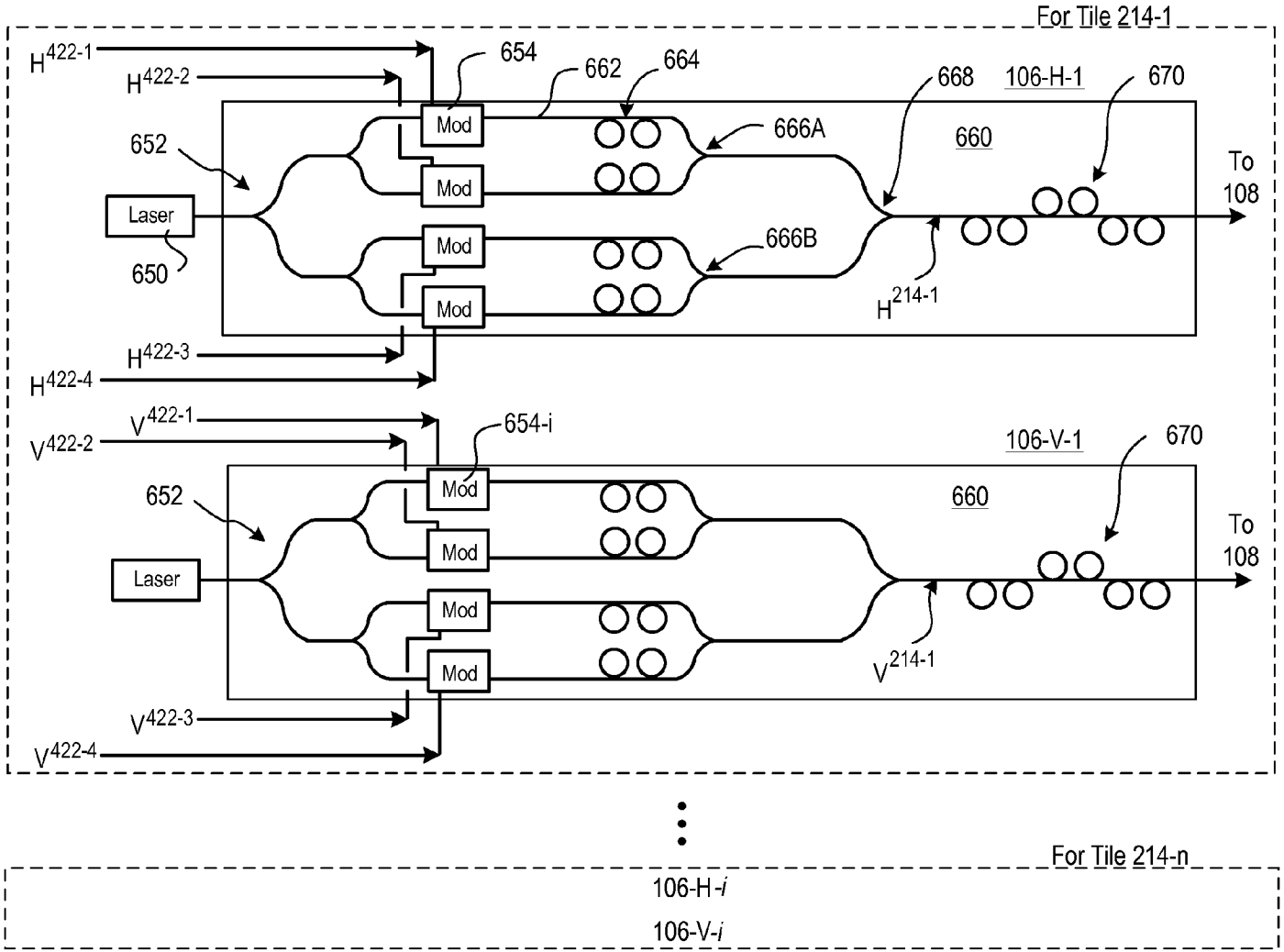
FIG. 6 depicts an embodiment of a photonic beamformer for use with the phased-array antenna of FIG. 1.

FIG. 6 depicts photonic beamformers 106-H-i and 106-V-i. As configured, paired photonic beamformers 106-H-i and 106-V-i collectively process all the signals for an individual tile 214. In particular, photonic beamformer 106-H-i processes the four H-polarized signals and photonic beamformer 106-V-i processes the four V-polarized signals. The photonic beamformers thus provide a 4-to-1 signal-combination ratio. In the illustrative embodiment, thirty-two pairs of photonic beamformers 106-H-i and 106-V-i are required to process the signals generated from all thirty-two tiles 214—2048 AEs 212—of antenna 102.

Photonic beamformers 106-H-i and 106-V-i have identical structures. In the embodiment depicted in FIG. 6, each beamformer includes optical splitter 652, modulators 654, and waveguide region 660. The waveguiding region comprises waveguides 662, optical junction points 665A/B and 667, and time delay elements 664, 666, and 668. In some embodiments, such as the one depicted in FIG. 8, a single splitter 652 (and a single laser 650) is used for paired photonic beamformers 106-H-i and 106-V-i.

Modulators 654 are used to convert the incoming signals from the electrical domain to the optical domain. In the illustrative embodiment, four modulators 654 are used in each beamformer to convert four incoming electrical signals to four optical signals. In some embodiments, the modulators are implemented Mach-Zehnder devices. In some other embodiments, electro-absorption modulators are used. Those skilled in the art will know how to make and use these and, as suitable, other types of modulators for use in conjunction with phased-array antenna 100.

Laser 650 generates a beam of light, which is split by optical splitter 652 so that a light beam is directed to each modulator 654. Since the beamformer is configured to receive four electrical domain signals, the splitter splits the optical beam generated by laser 650 into four optical beams (i.e., a 1×4 splitter) and delivers the beams to the four modulators 654. In some embodiments, light propagates from laser 650 to optical splitter 652 via an optical fiber. In the illustrative embodiment, optical splitter 652 is implemented as a surface waveguide.

Photonic signals generated by modulators 654 are launched into a network of waveguides 662. Referring again to FIGS. 4 and 5B, it will be appreciate that although delays have been accounted for as between the blocks of each sub-tile (i.e., in combiners 544A and 544B), delays between sub-tiles have not as yet been accounted for in electrical domain processing. Indeed, as the processing involves increasingly more spatially disparate AEs, the delays necessarily increase. Larger delays are more easily addressed in the optical domain than the electrical domain. As a consequence, to account for delays between sub-tiles (e.g., sub-tiles 316-1, 316-2, 316-3, and 316-4), the optical signal generated by each modulator is propagated to time delay element 664. An embodiment of time-delay element 664 is discussed later in this disclosure in conjunction with FIGS. 7A and 7B.

After appropriate delays have been applied to the optical signals, parallel 2-to-1 signal combinations occur at optical junctions 665A and 665B. Combining optical signals in this fashion is well known in the art. This reduces the number of optical signals from four to two.

After this four-to-two combination, the two signals are propagated to optional time-delays 666. Like time delay element 664, time delay element 666 accounts for delays between the antenna elements within sub-tiles within a given tile. As such, the delays might be fully accounted for by time delay element 664.

A second 2-to-1 signal combination occurs at optical junction 667. At this point, the one hundred twenty-eight signals originating from the 64 AEs 212 of tile 214-1 of the illustrative embodiment have been reduced to two signals: one H-polarized optical signal $H^{214-1}$ and one V-polarized signal $V^{214-1}$.

After the second 2-to-1 combination at optical junction 667, the single H-polarized optical signal propagating through OBFN-H-1 encounters final time-delay element 668. This time delay element is intended to account for the delays experienced at the tile level. The AEs within different tiles can be spatially quite remote from one another, at least compared to the delays experienced between sub-tiles or blocks within a given tile. As such, time delay element 668 will generally be required to apply a larger time delay than time delay element 666 or 664 and a delay that is far longer than those applied in the electrical-domain. An embodiment of time-delay element 668 is discussed below in conjunction with FIGS. 7A and 7B.

Figure 7B:
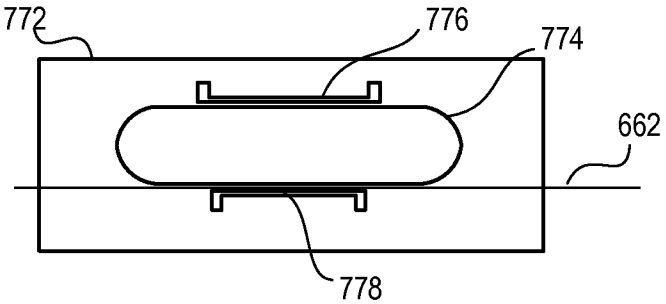
FIG. 7B depicts further detail of an optical ring resonator for use in the time-delay element of FIG. 7A.
Figure 7A:
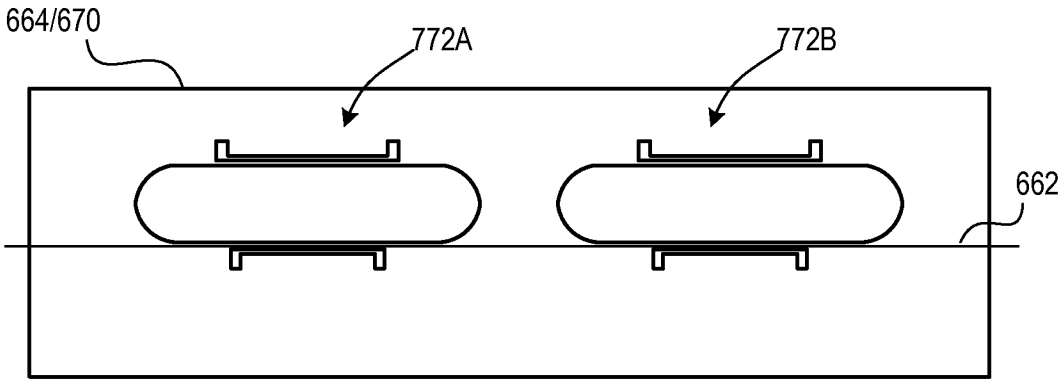
FIG. 7A depicts an embodiment of a time-delay element for use with the photonic beamformer of FIG. 6, wherein the time-delay element comprises cascaded optical ring resonators.

FIG. 7A depicts an embodiment of time-delay elements 664, 666, and 668. In accordance with the illustrative embodiment, a time-delay element is implemented via cascaded optical ring resonators, such as resonators 770A and 770B. It is to be understood that more than two optical ring resonators can be used to form time-delay elements 664, 666, and/or 668.

It is known that an optical ring resonator can be used to provide a tunable delay. Referring to FIG. 7B, an optical ring resonator 770 comprises waveguide 772, which can be shaped like a "race track," a heater 774 for (thermo-optical) tuning, and tunable power coupler 776 for altering the coupling coefficient of the resonator.

In operation, a portion of the optical signal propagating through waveguide 662 will evanescently couple to ring waveguide 772. Heater 774 is operable to apply heat to the ring, thereby causing it to expand. The alteration in ring size due to heating will cause a change in the resonance frequency of the ring. As such, a different frequency of light will couple to the ring. Tunable power coupler 776 alters the amount of power (the "amount" of the optical signal) that couples to the ring.

A single ring resonator 770 provides a tunable delay, but it is bandwidth limited. There is a tradeoff between the maximum delay achievable and the delay bandwidth. This is addressed by using more than one ring resonator; that is, by cascading ring resonators 770. See, for example Roeloffzen et al, "Ring resonator-based Tunable Optical Delay Line in LPCVD Waveguide Technology," Proc. Symp. IEEE/LEOS Benelux Chap, 2005.

Those skilled in the art will know how to make and use optical ring resonators to provide a tunable delay with desired performance attributes of maximum delay and delay bandwidth.

Waveguide region 660, and in particular time-delay elements 664, 666, and 668 are preferably implemented using TriPleX brand planar waveguide technology available from LioniX B.V., Enschede, the Netherlands. Waveguides that are produced using this technology are capable of achieving low propagation loss and small bend radius (i.e., for the ring resonators).

System Integration.

Figure 8:
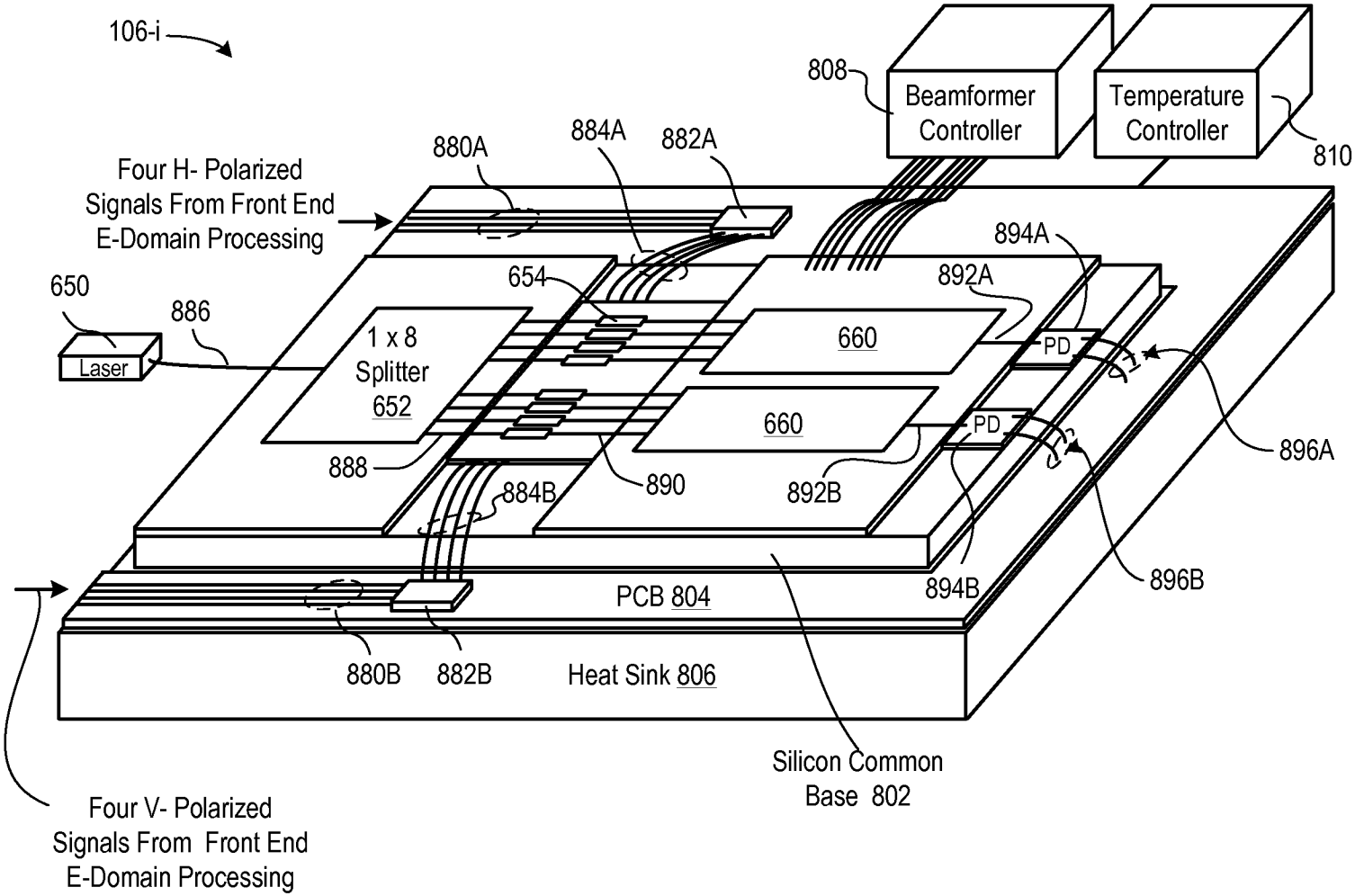
FIG. 8 depicts a perspective view of the photonic beamformer of FIG. 6 as integrated on a single chip.

FIG. 8 depicts a perspective view of paired photonic beamformers 106-H-i and 106-V-i and ancillary devices. In the embodiment depicted in FIG. 8, a single laser 650 delivers an optical beam over fiber 886 to a single 1×8 optical splitter 652. The splitter delivers an optical beam to each of eight modulators 654. The four H-polarized signals from front end electrical-domain processing of one tile 214 (e.g., tile 214-1) are conducted over wire traces 880A to modulator driver 882A. The driver produces electrical-domain drive signals that are conducted over traces 884A to each of the four modulators 654 in beamformer 106-H-i to modulate the optical beam provided thereto. Similarly, the four V-polarized signals from front end processing of tile 214-1 are conducted over wire traces 880B to modulator driver 882B. The drive signals are conducted over traces 884B to each of the four modulators 654 of beamformer 106-V-i. The modulators thereby generate optical signals that are based on the electrical signals from the front end.

Four optical signals are propagated from modulators 654 over waveguides 890 to waveguide region 660 of each of the paired beamformers 106-H-i and 106-V-i. The signals are processed as previously discussed in conjunction with FIG. 6. Beamformer controller 808 controls time delay elements 664, 666, and 668 of the beamformers. Temperature controller 808 maintains waveguide region 660 at substantially constant temperature.

Splitter 652, modulators 654, and waveguide region 660 are supported by silicon common base 802. The silicon base is disposed on heat sink 806. PCB 804 is disposed on heat sink 806 in a marginal region thereof around the perimeter of common base 802.

Waveguide region 660 of beamformer 106-H-i delivers a single H-polarized optical signal over waveguide 892A to photodetector 894A. Similarly, waveguide region 660 of beamformer 106-V-i delivers a single V-polarized optical signal over waveguide 892B to photodetector 894B. Each photodetector, which is preferably a balanced photodetector, converts the received optical signal to an electrical signal. The resulting H-polarized electrical signal is conducted over trace 896A and off chip to electrical-domain passive signal combiner 108-H and the V-polarized electrical signal is conducted over trace 896B and off chip to electrical-domain passive signal combiner 108-V.

Figure 9:
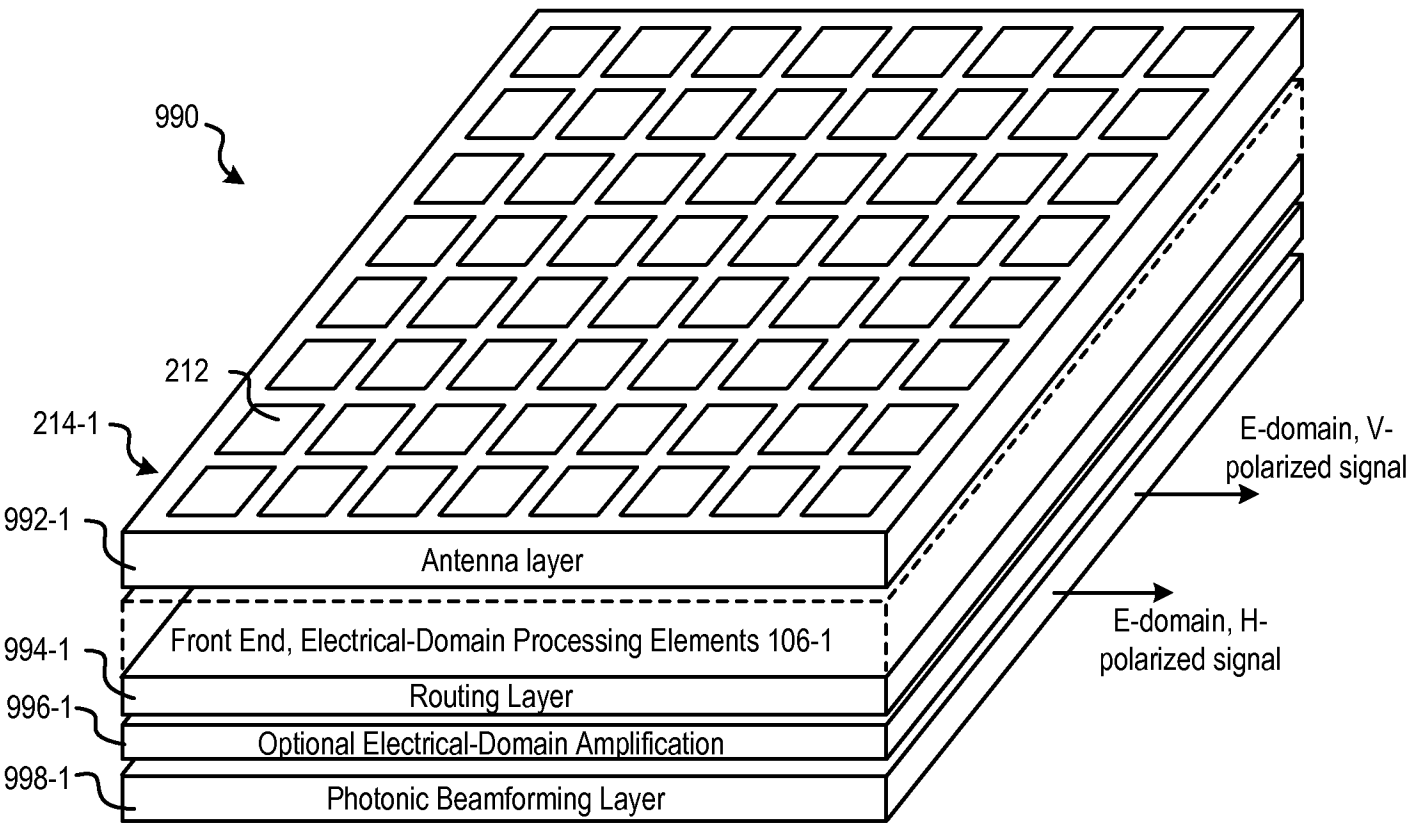
FIG. 9 depicts the salient features of an embodiment of an antenna tile of the antenna of FIG. 2, showing the integration of electronic-processing and photonic-processing elements.

FIG. 9 depicts the integration, into module 990, of tile 214-1, front-end processing elements 104-1, and beamformers 106-H-1 and 106-V-1.

As depicted in FIG. 9, AEs 212 composing tile 214-1 are disposed in/on antenna layer 992-1. Front-end, electrical-domain processing elements 104-1 are formed in/on layer processing element/routing layer 994-1, which is disposed directly beneath and aligned with antenna layer 992-1. Processing elements 104-1 provide front-end electrical-domain processing for the signals generated by all AEs 212 (sixty-four of them in the illustrative embodiment) in tile 214-1. Electrically-conductive traces (not depicted) in/on layer 994-1, and/or front-end, electrical-domain processing elements 104-1 of layer 994-1, are electrically coupled to AEs 212 of antenna layer 992-1.

Beneath layer 994-1 is optional electrical-domain amplification layer 966-1, which provides additional signal amplification if necessary. If present, layer 966-1 is electrically coupled to electrically-conductive traces in/on layer 994-1 to receive signals therefrom. Beneath layer 994-1 (or 996-1 if present) is photonic beamforming layer 998-1, in/on which photonic beamformers 106-H-1 and 106-V-1 are disposed. Electrically-conductive traces in/on photonic beamforming layer 998-1, and/or beamformers 106-H-1 and 106-V-1, are electrically coupled to electrically-conductive traces in/on layer 996-1 if present or electrically-conductive traces in/on layer 994-1 if layer 996-1 is not present.

Figure 10:
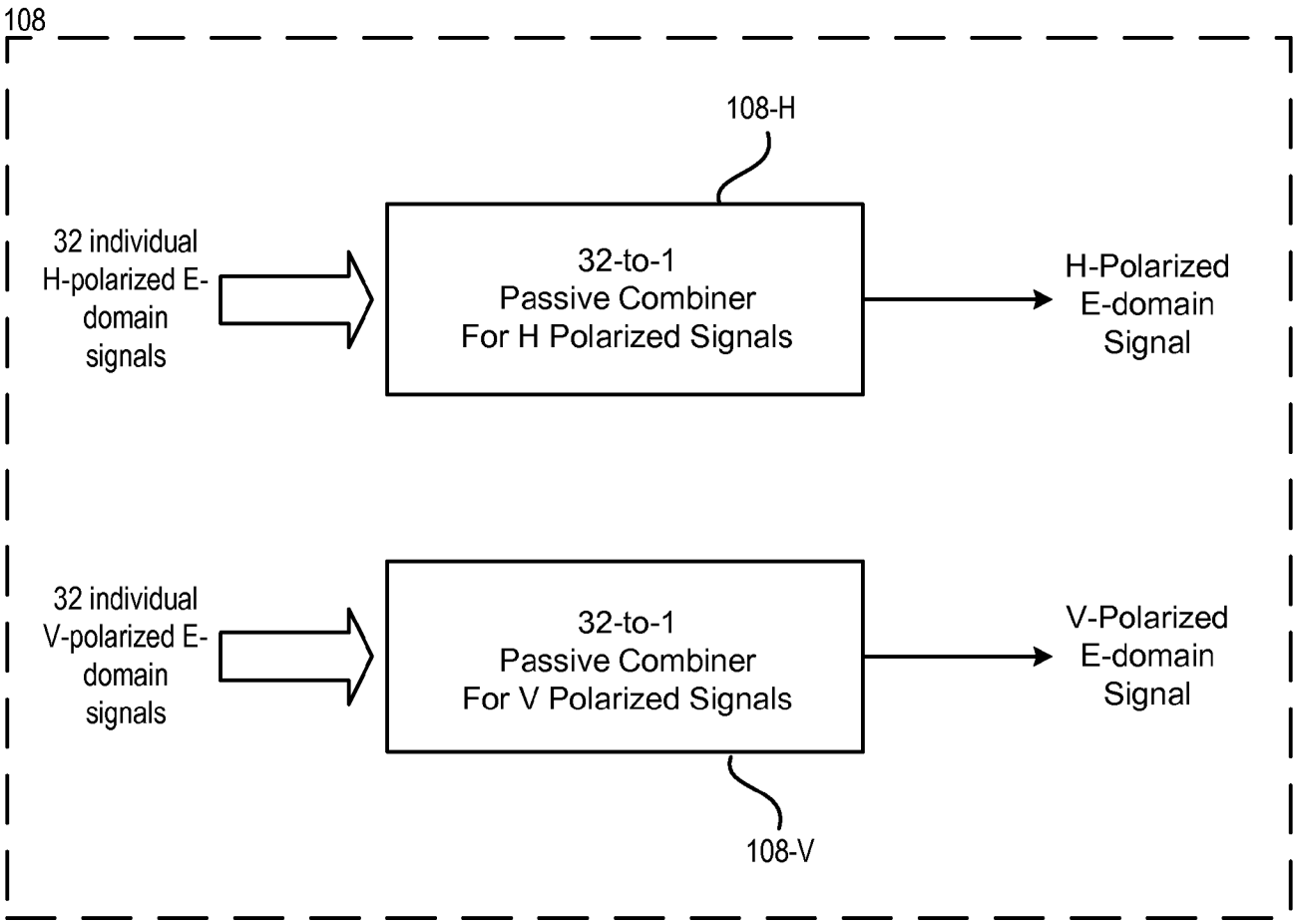
FIG. 10 depicts H-polarized signals and V-polarized signals, after photonic beamforming, being directed to respective electrical-domain passive signals combiners.

As previously discussed, the front-end electrical-domain processing and the photonic processing reduce the number of signals from each tile 214 to two: one electrical-domain, H-polarized signal and one electrical-domain, V-polarized signal. In the illustrative embodiment, there are thirty-two tiles; those tiles therefore generate thirty-two H-polarized e-domain signals and thirty-two V-polarized e-domain signals. These signals must be combined to provide a single H-polarized signal and a single V-polarized signal to the satellite receiver. This is accomplished, as depicted in FIG. 10, via two, 32-to-1, electrical domain, passive signal combiners 108H and 108V.

Passive, Electrical-Domain, Signal Combination.

Figure 11:
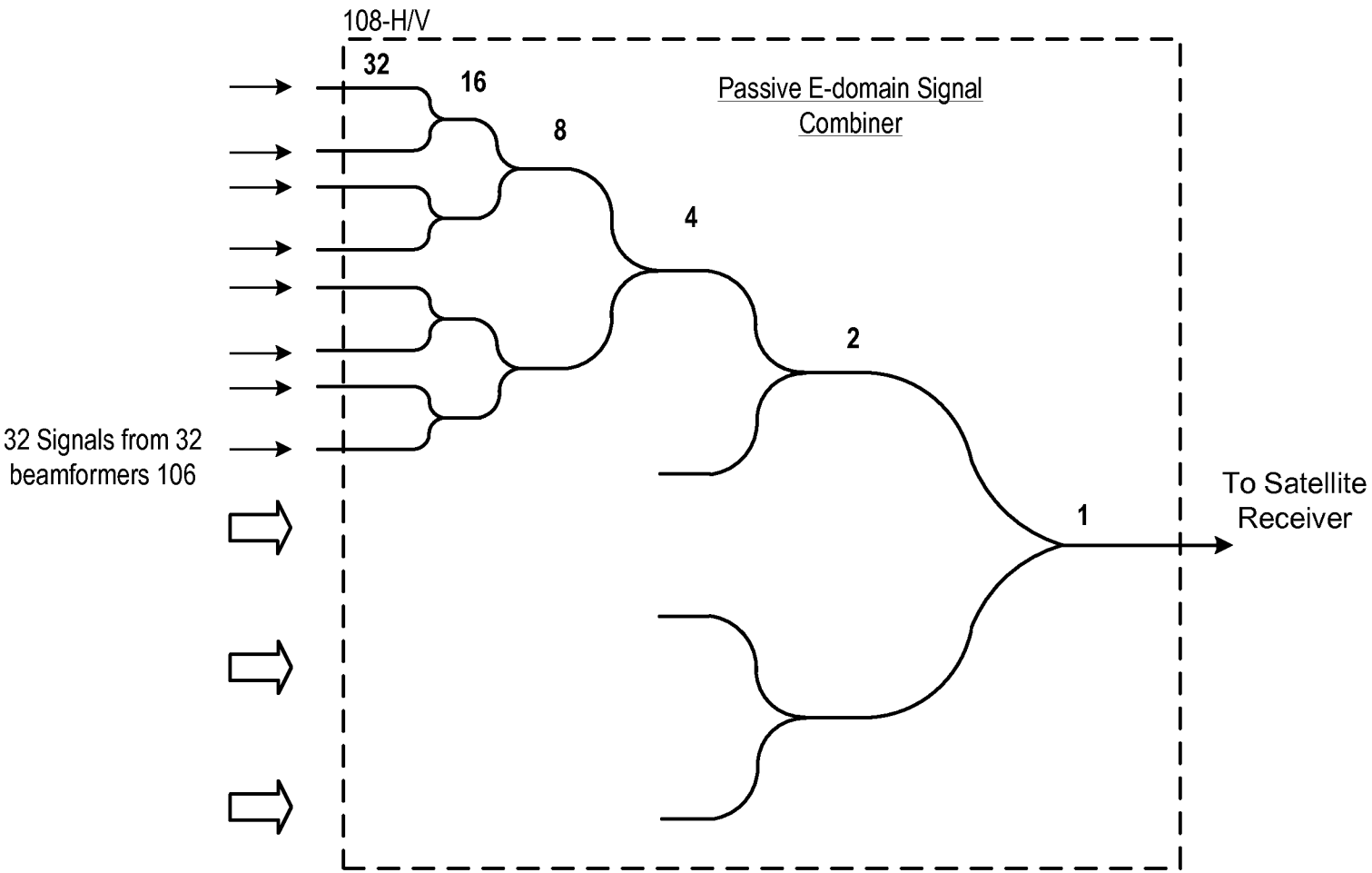
FIG. 11 depicts the operation of electrical-domain passive signals combiners of FIG. 10 for use with the phased-array antenna of FIG. 1.

Combiners 108H and 108V have identical structures. FIG. 11 depicts the functionality of combiners 108; it does not depict the actual structure of the combiner. As depicted in FIG. 11, thirty-two signals are combined in successive 2-to-1 combination stages in each combiner 108 as follows:

32->16->8->4->2->1

Combiners 108H and 108V can be implemented structurally as "Wilkinson" combiners, which are well known in the art. Wilkinson combiners/splitters are passive devices that have a simple structure that can be embodied with quarter-wave transformers and resistors on a PCB. After reading this disclosure, those skilled in the art will know how to make and use an electrical-domain combiner to combine signals in conjunction with the illustrative embodiment of the present invention.

Figure 12:
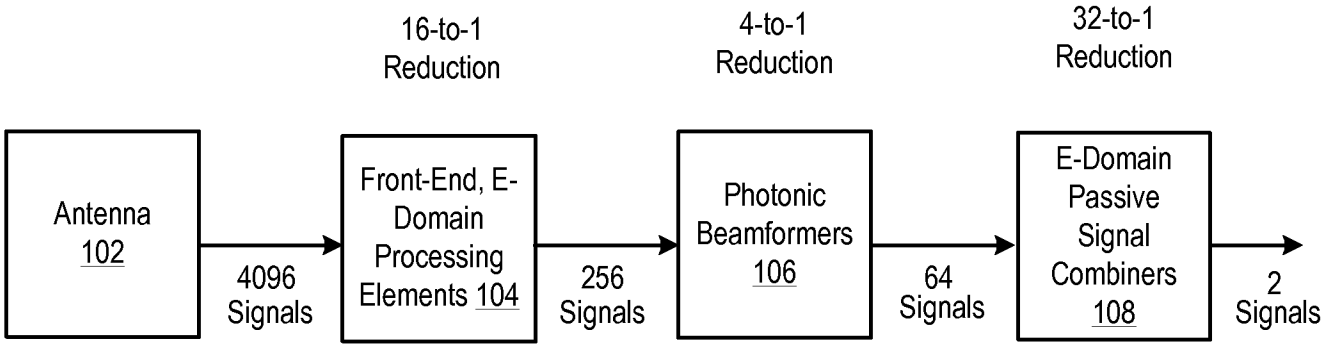
FIG. 12 depicts the signal-combination performance of the salient elements of the phased-array antenna 100.

FIG. 12 provides a summary of the performance of the various elements of the phased-array antenna 100. Assuming that antenna 102 comprises 2048 antenna elements 212 as in the illustrative embodiment, the antenna generates 4096 signals (2048 X-polarized and 2048 Y-polarized). In accordance with the illustrative embodiment, front-end electronic-domain processing elements 104 operate to combine signals at a ratio of 16-to-1, thus reducing the number of signals to 256 (128 H-polarized and 128 V-polarized). Photonic beamformers 106 combine signals at a ratio of 4-to-1, thereby reducing the number of signals to 64 (32 H-polarized and 32 V-polarized). Electrical-domain, passive signal combiners 108 combine signals at a ratio of 32-to-1, finally reducing the number of signals to two (1 H-polarized and 1 V-polarized).

Although the illustrative embodiment discloses a first electrical-domain signal-combination ratio of 16-to-1, an optical-domain signal-combination ratio of 4-to-1, and a final electrical-domain signal-combination ratio of 32-to-1, which is preferred, other ratios are possible without deviating from the spirit of the invention. That is, depending, for example, on the number of antenna elements required for an antenna design, it might be desirable to adopt a different group of signal-combination ratios for the various processing stages.

For example, in some embodiments, a tile comprises 144 AEs, comprising four sub-tiles, each sub-tile being a 6×6 array of antenna elements, a sub-tile comprising four blocks, each being a 3×3 array of antenna elements. In such an embodiment, and employing the same general processing approach, the first electrical-domain signal-combination ratio will be 36-to-1, while the other signal-combination ratios are the same as in the illustrative embodiment.

After reading this disclosure, those skilled in the art will be able to apply the present teachings to develop other signal-combination ratios, as necessary or desirable while maintaining (a) a first stage of electrical-domain processing wherein some signal delay and some combination occurs, (b) a single stage of optical-domain processing wherein remaining signal delays are finalized and (c) a final stage of electrical-domain processing to reduce the number of signals to two.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A phased-array antenna comprising:

a plurality of antenna elements for receiving an EM signal and each generating a signal in response thereto, wherein the antenna elements are grouped for signal processing in successively larger groupings, including a block, a sub-tile composed of plural blocks, and a tile composed of plural sub-tiles;

a first stage of processing via electrical-domain processing elements that process the signals generated by the plurality of antenna elements, wherein the processing comprises combining the signals to generate a first group of combined electrical signals and imparting first signal delays that compensate for different times at which the antenna elements within the blocks of a given sub-tile receive the EM signal due to spatially disparate locations thereof with respect to one another;

a second stage of processing via optical-domain processing elements including a plurality of photonic beamformers operating in parallel to one another defining a single stage of photonic beam forming, wherein each of the photonic beamformers receives a portion of the first group of combined signals, and wherein the photonic beam formers are configured to:

(a) convert the first group of combined electrical signals to a first group of optical signals;

(b) impart second signal delays that compensate for different times at which the antenna elements within sub-tiles of a given tile receive the EM signal due to spatially disparate locations thereof with respect to one another;

(c) impart third signal delays that compensate for different times at which the antenna elements within different tiles receive the EM signal due to spatially disparate locations thereof with respect to one another;

(d) combine the first group of optical signals to generate a second group of optical signals;

means for converting the second group of optical signals to a second group of electrical signals; and means for combining the second group of electrical signals to a first output signal having a first polarity and a second output signal having a second polarity.

2. The phased-array antenna of claim 1 wherein each antenna element generates a first signal and a second signal in response to receiving the EM signal.

3. The phased-array antenna of claim 2 wherein the combining performed by the first stage of processing elements provides a first signal-combination ratio of 16-to-1.

4. The phased-array antenna of claim 3 wherein the combining performed by the second stage of processing provides a second signal-combination ratio of 4-to-1.

5. The phased-array antenna of claim 4 wherein the combining of the second group of electrical signals to a first output signal and a second output signal provides a third signal-combination ratio of 32-to-1.

6. The phased-array antenna of claim 2 wherein each block comprises a 2×2 array of antenna elements, each sub-tile comprises a 2×2 array of blocks, and each tile comprises a 2×2 array of sub-tiles.

7. The phased-array antenna of claim 6 wherein the electrical-domain processing elements are segregated into plural instantiations, wherein each instantiation comprises:

a) four instantiations of a first portion of the processing elements, wherein each instantiation of the first portion processes the first signal and the second signal generated by each block of antenna elements and generates two signals; and b) a second portion of the processing elements, wherein the second portion receives the two signals generated by each of the four instantiations of the first portion and generates two signals.

8. The phased-array antenna of claim 7 comprising four instantiations of the electrical-domain processing elements per tile of antenna elements in the phased-array antenna.

9. The phased-array antenna of claim 8 wherein eight signals collectively generated by the four instantiations of the electrical-domain processing elements are received by a first and a second instantiation of the photonic beamformers, wherein each such instantiation processes four of the eight signals.

10. The phased-array antenna of claim 9 wherein each instantiation of the photonic beamformer generates a single optical signal.

11. The phased-array antenna of claim 7 wherein, for the two signals generated by the second portion of each instantiation of the electrical domain processing elements, one of the two signals has the first polarity and the other of the two signals has the second polarity.

12. The phased-array antenna of claim 9 wherein each of the four signals processed by the first instantiation of the beam former have the first polarity and each of the four signals processed by the second instantiation of the beam former have the second polarity.

13. The phased-array antenna of claim 7 wherein each instantiation of the first portion of the processing elements is implemented in a first integrated-circuit chip, the four instantiations thereof therefore disposed on four first integrated chips, and further wherein the second portion of the processing elements is implemented in a second integrated-circuit chip.

14. The phased-array antenna of claim 10 wherein each tile of antenna elements, the four instantiations of the electrical-domain processing elements, and the two instantiations of the photonic beamformer collectively define a module, the plurality of antenna elements therefore including plural modules, each of which is physically distinct from all other modules.

15. The phased-array antenna of claim 14 wherein the module comprises:

an uppermost layer, wherein the uppermost layer comprises the tile of antenna elements;

a second layer beneath, physically aligned with, and electrically coupled to the uppermost layer, wherein the second layer comprises the four instantiations of the electrical-domain processing elements; and a third layer beneath, physically aligned with, and electrically coupled to the second layer, wherein the third layer comprises the two instantiations of the photonic beamformer.

16. The phased-array antenna of claim 15 comprising thirty-two modules.

17. The phased-array antenna of claim 1 wherein the EM signal is a $K_u$-band signal.

18. A phased-array antenna comprising:

a plurality of modules, each module comprising:

an uppermost layer, wherein the uppermost layer comprises a plurality of antenna elements for receiving an EM signal and each generating a signal in response thereto, wherein the plurality of antenna elements define a tile, and wherein, for signal processing, the antenna elements of the tile are logically grouped into plural sub-tiles, and the antenna elements of each sub-tile are logically grouped into plural blocks;

a second layer beneath, physically aligned with, and electrically coupled to the uppermost layer, wherein the second layer comprises electrical-domain processing elements that combine the signals generated by plurality of antenna elements and that impart first signal delays that compensate for different times at which the plural blocks of antenna elements in a given sub-tile receive the EM signal due to spatially disparate locations of such blocks with respect to one another; and a third layer beneath, physically aligned with, and electrically coupled to the second layer, wherein the third layer comprises photonic beamformers operating in parallel with one another, wherein the photonic beamformers receive the signals after processing by the electrical-domain processing and after conversion to a first group of optical signals, and further wherein:

(a) the photonic beam formers impart second signal delays that compensate for different times at which plural sub-tiles of antenna elements in the tile receive the EM signal due to spatially disparate locations of the sub-tiles with respect to one another; and (b) the photonic beam formers impart third signal delays that compensate for different times at which the plurality of antenna elements in the tile receive the EM signal as compared to other antenna elements arranged in other tiles in other of the modules due to spatially disparate locations of the tiles with respect to one another, wherein:

the first signal delays are shorter than the second signal delays, and the second signal delays are shorter than the third signal delays.

19. The phased-array antenna of claim 18 and further wherein the photonic beam formers combine the first group of optical signals to generate a second group of optical signals.

20. The phased-array antenna of claim 19 and further comprising a plurality of photodetectors for converting the second group of optical signals to a group of electrical signals; and an electrical domain passive signal combiner for combining the second group of electrical signals from each module, resulting in a total of two output signals.

21. The phased-array antenna of claim 19 wherein each tile has sixty-four antenna elements, each sub-tile has sixteen antenna elements, and each block has four antenna elements.

* * * * *